US007323135B2

(12) United States Patent
Choi et al.

(10) Patent No.: US 7,323,135 B2
(45) Date of Patent: Jan. 29, 2008

(54) APPARATUS FOR CONTROLLING GAS LAYER THICKNESS ON THE SURFACE OF CASTING ROLLS IN A TWIN ROLL STRIP CASTER

(75) Inventors: Ju-Tae Choi, Kyungsangbook-do (KR); Han-Nam Cheong, Kyungsangbook-do (KR); Yong-Gi Lee, deceased, late of Kyungsangbook-do (KR); by Kyung-Ah Lee, legal representative, Pohang-si (KR)

(73) Assignees: POSCO (KR); Research Institute of Industrial Science & Technology (KR)

( * ) Notice: Subject to any disclaimer, the term of this patent is extended or adjusted under 35 U.S.C. 154(b) by 665 days.

(21) Appl. No.: 10/499,908

(22) PCT Filed: Dec. 20, 2002

(86) PCT No.: PCT/KR02/02396

§ 371 (c)(1),
(2), (4) Date: Jun. 22, 2004

(87) PCT Pub. No.: WO03/055624

PCT Pub. Date: Jul. 10, 2003

(65) Prior Publication Data

US 2005/0253314 A1 Nov. 17, 2005

(30) Foreign Application Priority Data

Dec. 22, 2001 (KR) ..... 10-2001-0083717

(51) Int. Cl.
*C21D 11/00* (2006.01)

(52) U.S. Cl. ..... 266/90; 164/428; 164/415

(58) Field of Classification Search ..... 266/90; 164/428, 415

See application file for complete search history.

(56) References Cited

U.S. PATENT DOCUMENTS 7,021,364 B2 * 4/2006 Park et al. ..... 164/428

FOREIGN PATENT DOCUMENTS

| | | |
|---|---|---|
| JP | 3-66453 A | 3/1991 |
| JP | 6-297108 A | 10/1994 |
| JP | 6-328205 A | 11/1994 |
| JP | 7-276004 A | 10/1995 |

(Continued)

*Primary Examiner*—Scott Kastler
(74) *Attorney, Agent, or Firm*—The Webb Law Firm, P.C.

(57) ABSTRACT

An apparatus for controlling gas layer thickness on the surface of casting rolls in a twin roll strip caster includes: a pair of chambers fixedly mounted on both lateral portions of the meniscus shield in a width direction of a strip; blocking units for blocking introduction of pollutants into the molten metal pool, wherein each of the blocking units includes front and rear barrier members which are mounted on each of the chambers and in close contact with an outer periphery of each casting roll and a blower for injecting inert gas toward the outer periphery of each casting roll; operating units for adjusting the thickness and the width of gas layers at both ends of the casting rolls, wherein each of the operating units includes suction lines connected with each chamber to transmit a suction force to ends of each casting roll and a pair of movable plates slidably assembled to both side portions within each chamber for being reciprocated by movable members; and a control unit for controlling the suction force of the suction lines and the movable members by using means for measuring surface conditions and the thickness of the strip. Delayed solidification at strip edges is prevented to improve the grade in shape and yield of the strip.

21 Claims, 7 Drawing Sheets

FOREIGN PATENT DOCUMENTS

| | | | |
|---|---|---|---|
| JP | 9-103845 | A | 4/1997 |
| JP | 9-327753 | A | 12/1997 |
| JP | 11-10289 | A | 1/1999 |
| KR | 10-1998-0057611 | A | 7/2000 |
| KR | 10-1999-0042986 | A | 5/2001 |
| KR | 10-2000-0079600 | A | 6/2002 |
| WO | WO 93/22087 | * | 11/1993 |

* cited by examiner

● : OXIDE SCALE POWDER(OXIDE)
∘ : ABRADED EDGE DAM POWDER(OXIDE)
∘ : INFLOW OXYGEN(GAS)
• : ATMOSPHERIC GAS ($N_2$)

APPARATUS FOR CONTROLLING GAS LAYER THICKNESS ON THE SURFACE OF CASTING ROLLS IN A TWIN ROLL STRIP CASTER

TECHNICAL FIELD

The present invention relates to an apparatus for controlling the gas layer thickness on casting rolls in a twin roll strip caster which extrudes molten metal through a nip between a pair of casting rolls and rapidly cools molten metal through contact with the rolls to produce a strip. In particular, the controlling apparatus removes heat transfer resistant particles from fluid-accumulating portions in specific edge areas on the casting rolls to enhance cooling ability as well as directly controls the gas layer thickness at interfaces between the rolls and solidification shells in response to hot banding at both ends of the strip during casting so that cooling ability in a width direction of the casting rolls is adjusted to prevent hot banding or bulging owing to delayed solidification, by which thickness profiles at both edges of the strip can be improved to raise the grade in shape of the strip and the yield thereof.

BACKGROUND ART

As shown in FIG. 1, a conventional twin roll strip caster 100 feeds molten metal via an immersion nozzle 4 to form molten metal pool 5 in a space surrounded by two casting rolls 1 and 1*a* and edge dams 2 attached to both ends of the casting rolls 1 and 1*a*. Then, the strip caster 100 counter-rotates the casting rolls 1 and 1*a* so as to rapidly cool molten metal via heat flux into the casting rolls 1 and 1*a* owing to contact between the casting rolls 1 and 1*a* and molten metal, thereby producing a strip 6.

A meniscus shield 9 is disposed above the molten metal pool 5 for shielding molten metal from the open air. Gas inlets 8 are provided at both lateral portions of the meniscus shield 9 to feed inert gas to a surface of the molten metal pool 5. Brush rolls 7 are installed beyond the gas inlets 8 to brush the surface of the casting rolls 1 and 1*a* to remove foreign materials therefrom.

The strip 6 produced by the above strip caster 100 has a cross-sectional profile which is closely related to contours of the rolls in a casting space. It is most preferable that the strip 6 has a quadrangular cross section or a configuration with a slightly convex central portion so that it is finely rolled in a cold rolling or an after treatment to obtain a fine flatness of a final article. In order that the strip 6 may have such a fine configuration, edges of the rolls are straight or slightly concave at a-roll nip where the two casting rolls 1 and 1*a* are most adjacent to each other in the casting space.

In practice, however, the casting rolls 1 and 1*a* are heated to a high temperature during casting so that heat expansion causes the casting rolls 1 and 1*a* to be convex at their central outer peripheries although the central outer peripheries are straight when cooled down. Because the frozen strip has a cross sectional profile which accurately reproduces a cross sectional configuration of the casting space at the nip of the casting rolls 1 and 1*a*, the cross sectional profile of the produced strip is increased in thickness around the edges compared to the central portion.

Such a cross sectional profile acts a factor of a defective strip, which causes rolling defects in cold rolling, thereby degrading the quality and yield of a final article.

In order to compensate such heat expansion of casting rolls, as shown in FIG. 3, a casting roll 1, 1*a* is generally provided with roll crowns so that a middle portion b of the casting roll 1, 1*a* is flat or concave and both ends e thereof are concave. Although the crowns are formed in the casting roll 1, 1*a*, a strip 6 may be flat at a central portion B thereof but thicker at both edges E thereof, as shown in FIG. 4, owing to hot banding or bulging of molten metal from a central region of the strip 6 in a thickness direction. These edges of the strip 6 have a temperature higher than that of the central portion B. When a hot strip camera is used to photograph the hot strip under the roll nip between the casting roll 1, 1*a*, the edges are observed bright against the central portion as shown in FIG. 2.

If bulging or hot banding occurs at the both edges E of the strip 6 as described above, the quality and yield of the strip is disadvantageously degraded.

For the purpose of commercializing the Strip Casting (S/C) process, it is essential to develop a technology which can prevent the both edges E of the strip 6 from bulging or hot banding, thereby stabilizing the strip casting process while improving the quality and yield of the strip 6.

The above described methods for preventing the bulging of the both edges E in the strip 6 have been examined in various aspects by a number of inventors. In an early development stage of the S/C process, the inventors tried to prevent hot banding or bulging by adjusting the initial crowns of the casting roll and transversely differentiating the cooling ability of the casting roll since they believed that hot banding or bulging is caused by relative degradation in the freezing ability at the roll edges E.

For example, Japanese Laid-Open Patent Application Serial Nos. H6-297108 and H6-328205 disclose methods of adjusting the cooling ability by providing a plurality of cooling channels which are divided in a transverse direction. Japanese Laid-Open Patent Application Serial No. H9-103845 discloses a method of adjusting the quantity of roll crowns so that a central region in a thickness direction of a strip edge in a roll nip can have a solid fraction at a designated value or more. As yet another approach, Japanese Laid-Open Patent Application Serial No. H9-327753 discloses a method of adjusting the cooling ability in a transverse direction of rolls via differential procedures during surface treatment of the rolls.

The above conventional methods can more or less prevent bulging at both edges E of a strip in some casting conditions where casting roll 1, 1*a* of a strip caster 100 has identical specifications, steel are of equal type, or strips have the same thickness. However, there are drawbacks in that operating factors should be changed in response to variation of steel category, strip thickness, heat size and so on.

The assignee of the invention previously proposed to prevent hot banding owing to delayed solidification at strip edges as disclosed in Korean Laid-Open Patent Application Serial Nos. 1998-57611 which pertain to methods of adjusting the cooling ability of roll edges by feeding nitrogen gas, 1999-42986 which pertains to a method of regulating the thickness and composition of gas films on the surface of casting rolls, and 2000-79600 which pertains to a method of preventing inflow of abraded edge dam powder to lateral portion of casting rolls.

However, these conventional methods of adjusting the roll crowns, differentiating the cooling ability in a roll width direction and differentiating the surface treatment in a roll width direction have a fundamental problem in that they cannot actively cope with variation of steel types to be cast. These conventional methods also cannot overcome problems in that the aspect of hot banding is remarkably varied at both the strip edges according to the material of the edge dams or the type or composition of atmospheric gas and hot banding at both the strip edges becomes more severe even under equal casting conditions as casting time lapses, which is also called time dependency of hot banding.

In the meantime, FIG. 5 illustrates behavior of fluid existing around the casting roll. While this behavior is a typical phenomenon applicable to all kinds of fluid which can perform mass transfer under weak driving force, FIG. 5 illustrates factors which have direct influence on hot banding at both edges E of the strip 6 during actual strip casting. Those factors include an atmospheric gas such as nitrogen, externally introduced gas such as oxygen, ceramic powder abraded from the edge dams 2 due to friction between the edge dams 2 and end faces 14 of the casting roll 1, 1*a*, and fine oxide scale peeled off from the surface of the casting roll 1, 1*a* and the strip 6. FIG. 6 illustrates variation in build-up of abraded edge dam powder and oxide, which are deposited on edges and central portions of the casting roll surfaces upon completion of actual casting.

FIG. 5 schematically shows in its left part a simulation result of typical fluid behavior around the casting roll 1, 1*a* during rotation of the casting roll 1, 1*a*. Where the casting roll 1, 1*a* is rotated during casting, three different kinds of forces F1, F2 and F3 act on fluid around the roll surface, roll sides and a roll shaft 25 owing to centrifugal force. The driving force of these three forces are determined according to the rotation rate of a rotating body, physical properties of fluid and surface characteristics of the roll. Fluid concentration to the ends of the casting roll 1, 1*a* seems a general phenomenon in the rotating roll. Whereas, experimental results show that the quantity and the width W of fluid concentrating to the edges are determined owing to interaction among the driving forces F1, F2 and F3 having different directions from one another.

That is, the driving force F2 does not exist where fluid is not fed along the sides of the casting roll 1, 1*a*. Then, the driving force F3 gradually drives fluid on the roll surface toward the edges adjacent to the roll-sides so that fluid is built up around the edges. In case that fluid is continuously fed along the roll sides, the relatively large force F2 is generated so that fluid is concentrated to the edges. Then, the position or width of concentrated fluid is determined based upon the force balance between the driving forces F2 and F3.

The following will summarize influences of fluid to hot banding at both ends of the strip in strip casting:

First, the gas film thickness of nitrogen or atmospheric gas at the surface of the rotating body such as the casting roll 1, 1*a*, is not uniform in a width direction of the roll so that the both ends of the roll are relatively thicker than a central portion thereof to remarkably deteriorate the cooling ability of the roll. As a result, hot bands are created at the both ends of the roll where molten metal is not sufficiently frozen.

Second, the air directly contacts with the side of the rotating roll 1, 1*a* and the roll shaft 25, from which oxygen gas moves along a path b shown in FIG. 5 to the edge surface where it is built up. Because oxygen is expansible gas with a low solubility, it degrades close contact between a solidification shell and the roll as well as accelerates oxidation of the solidification shell. As a result, an oxide scale layer is additionally formed to degrade freezing ability.

Third, fluid having a large value of heat transfer resistance is continuously fed as fine ceramic powder is produced owing to friction between the edge dams 2 and the end faces 14 of the rotating casting rolls 1, 1*a*, a large quantity of roll surface oxide scale is formed by the brush rolls 7 which are mounted to remove roll surface pollutants, and oxide scale is detached from the strip. Such fluid is built up in the end portions of the casting roll 1, 1*a* to remarkably degrade the cooling ability between solidification shell and the roll.

As generally known, the boundary layer thickness 5 of fluid formed on a floating plate is proportional to the square root of a Reynolds number of gas as expressed in Equation 1, $$\delta \propto (\upsilon x/Vp)^{1/2} \qquad \text{Equation 1,}$$

wherein $\upsilon$ is the kinetic viscosity of gas, x is the length of the plate from a leading end, and Vp is the moving rate of the plate.

The type of fluid existing between the casting roll 1, 1*a* and molten metal and the thickness of a film have greater influence on formation of the solidification shell. In casting of a thin film, heat transfer resistance controlling the heat flux between molten metal and the casting roll includes a casting roll body, a gas curtain between the roll and molten metal and oxide film or ceramic powder. The overall heat transfer coefficient between molten metal and the casting roll at a summit is expressed as in Equation 2, $$h=1/(d_r/k_r+d_g/k_g+d_s/k_s+d_c/k_c) \qquad \text{Equation2,}$$

wherein d is thickness, k is heat transfer ratio, subscript r is casting roll, subscript g is gas, subscript s is oxide film on the surface of molten metal, c is ceramic powder such as-oxide scale powder or abraded edge dam powder having a large value of heat transfer resistance.

It can be understood from Equations 1 and 2 that the overall heat transfer coefficient is varied by large values according to the type or composition of gas existing between the casting roll and molten metal, the thickness of gas layers, the type and thickness of oxide film and the type or thickness of abraded ceramic powder. The overall heat transfer coefficient rapidly decreases as the thickness $\delta$ of the gas film increases or the accumulation degree of an oxide layer or abraded ceramic powder increases.

That is, it is judged that bulging or hot banding owing to insufficient solidification occurs since fluid accumulating portions 16 at the both ends e of the roll have a heat transfer resistance between the roll and the solidification shell which is remarkably larger than that of the lateral middle portion b of the roll. The foregoing simulation result of typical fluid behavior tends to coincide with hot banding at both the strip edges in actual strip casting.

According to the foregoing three reasons, that is, thickness increase of the nitrogen gas layer at the both ends e of the roll, introduction of oxygen from the sides of the casting roll 1, 1*a* and local build-up of the heat transfer resistant particles such as oxide scale or abraded powder between the edge dams 2 and the end faces 14 of the casting roll 1, 1*a*, the cooling ability at the ends e of the roll are remarkably degraded compared with the middle portion b of the roll leading to bulging or hot banding owing to insufficient solidification. As the casting time lapses, the particles having high heat transfer resistant are increasingly built up at the ends e of the roll, thereby accelerating hot banding or bulging owing to delayed solidification.

The present invention has been made to solve the foregoing problems of the prior art and it is therefore an object of the present invention to provide an apparatus for controlling the gas layer thickness on casting rolls, which blocks introduction of heat transfer resistant particles in order to prevent bulging or hot banding owing to insufficient solidification or non-solidification at strip edges as well as compares the thickness of the gas layer at a central barrel portion of a casting roll with the thickness of the gas layers at the both ends of the casting roll, thereby effectively adjusting the cooling ability of the casting roll in a width direction of the strip.

SUMMARY OF THE INVENTION

According to an aspect of the invention for realizing the above objects, in a twin roll strip caster for casting a strip which includes a pair of counter-rotating casting rolls, edge dams disposed at both ends of the casting rolls for forming a molten metal pool, a meniscus shield covering over the molten metal pool for blocking contact between the open air and molten metal and brush rolls each for brushing the surface of each of the casting rolls, an apparatus for controlling gas layer thickness on the surface of the each casting roll 1 or 1*a* comprises: a pair of chambers fixedly mounted on both lateral portions of the meniscus shield in a width direction of a strip, and each having a U-shaped cross section with its opened lower end being opposed to an outer periphery of the each casting roll; blocking units for blocking introduction of pollutants into the molten metal pool, wherein each of the blocking units includes front and rear barrier members, which are detachably mounted on front and rear walls of each of the chambers and in close contact by their undersides with the outer periphery of the each casting roll, and a blower for injecting inert gas toward the outer periphery of the each casting roll; operating units for adjusting the thickness and the width of gas layers at both ends of the casting rolls, wherein each of the operating units includes: a pair of suction lines communicating respectively with both side portions of the each chamber to transmit suction force to ends of the each casting roll, a pair of movable plates slidably assembled to both end portions within the each chamber, and a pair of movable members for reciprocating the movable plates; and a control unit including a controller for generating a suction force control signal $e_p$ and a width control signal $e_w$ based upon measured values from a camera for measuring surface conditions of the strip and a thickness meter for measuring the thickness of the strip, and a single action controller for receiving the control signals from the single action controller and electrically connected to the suction lines and the operating members.

According to another aspect of the invention for realizing the above objects, in a twin roll strip caster which includes a pair of casting rolls and 1*a* equipped with edge dams for forming a molten metal pool, a meniscus shield covering over the molten metal pool for blocking contact between the open air and molten metal and brush rolls each for brushing the surface of each of the casting rolls, an apparatus for controlling gas layer thickness on the surface of the each casting roll comprises: a pair of chambers fixedly mounted on both lateral portions of the meniscus shield in a width direction of a strip; blocking units for blocking introduction of pollutants into the molten metal pool, wherein each of the blocking units includes front and rear barrier members, which are mounted on each of the chambers and in close contact with an outer periphery of the each casting roll, and a blower for injecting inert gas toward the outer periphery of the each casting roll; operating units for adjusting the thickness and the width of gas layers at both ends of the casting rolls, wherein each of the operating units includes suction lines connected with the each chamber to transmit suction force to ends of the each casting roll 1 or 1*a* and a pair of movable plates slidably assembled to both side portions within the each chamber for being reciprocated by movable members; and a control unit for controlling the suction force of the suction lines and the movable members by using means for measuring surface conditions and the thickness of the strip.

DETAILED DESCRIPTION OF THE INVENTION

The following detailed description will present a preferred embodiment of the invention in reference to the accompanying drawings.

Figure 7:
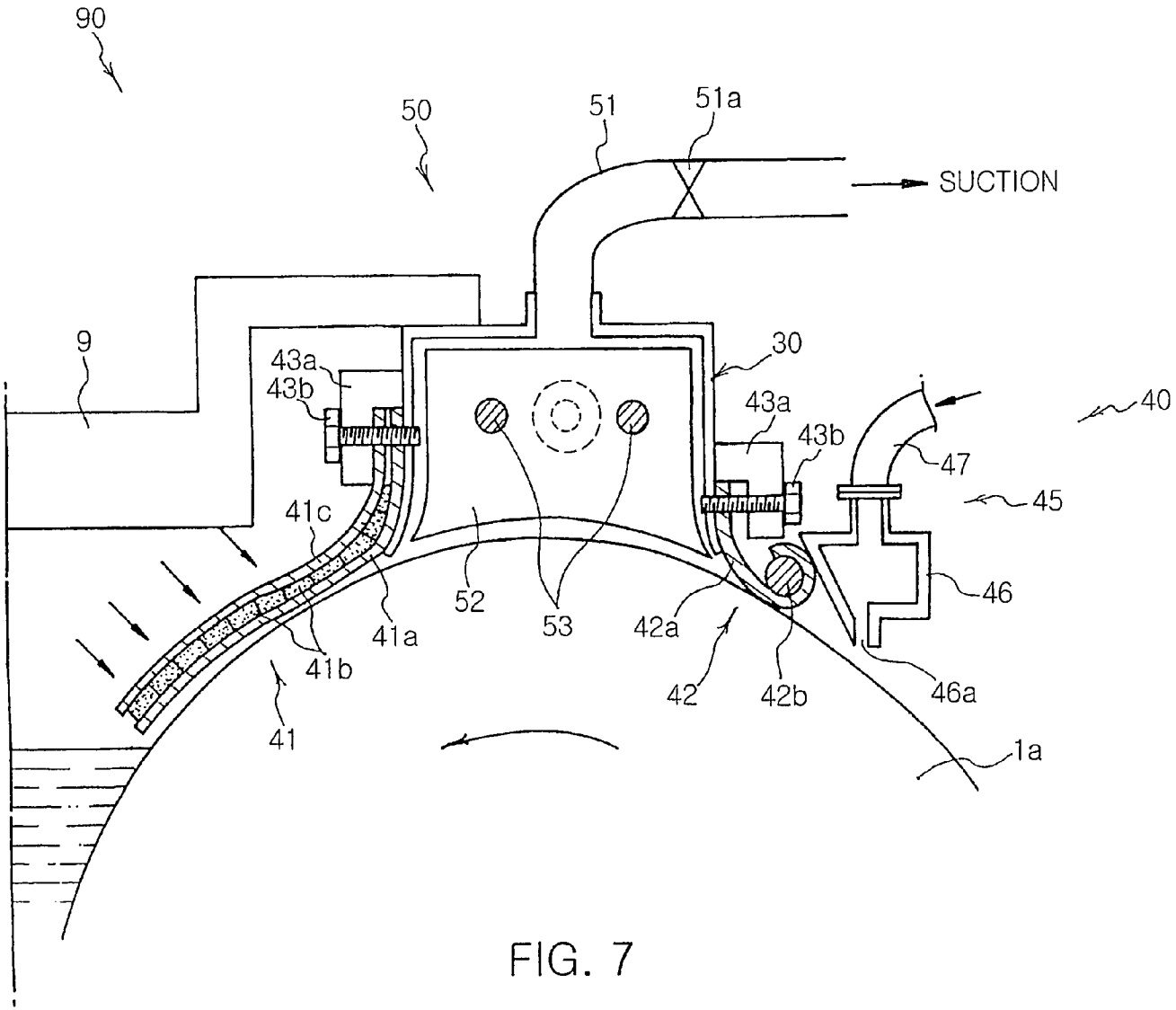
FIG. 7 is a sectional view of an apparatus for controlling gas layer thickness on the surface of a casting roll in a twin roll strip caster according to the invention.
Figure 8:
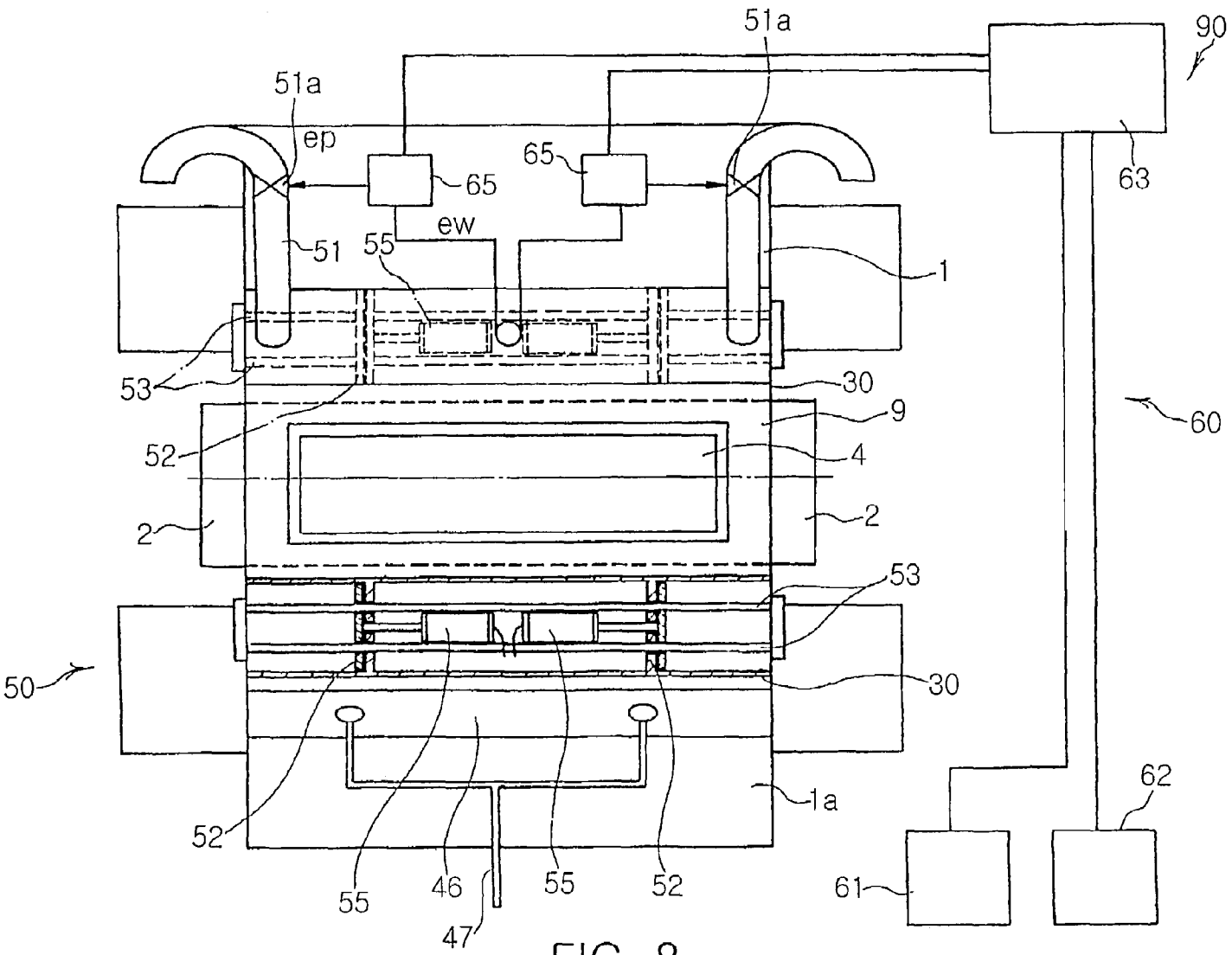
FIG. 8 is a plan view of the apparatus for controlling gas layer thickness on the surface of a casting roll in a twin roll strip caster according to the invention.
Figure 9:
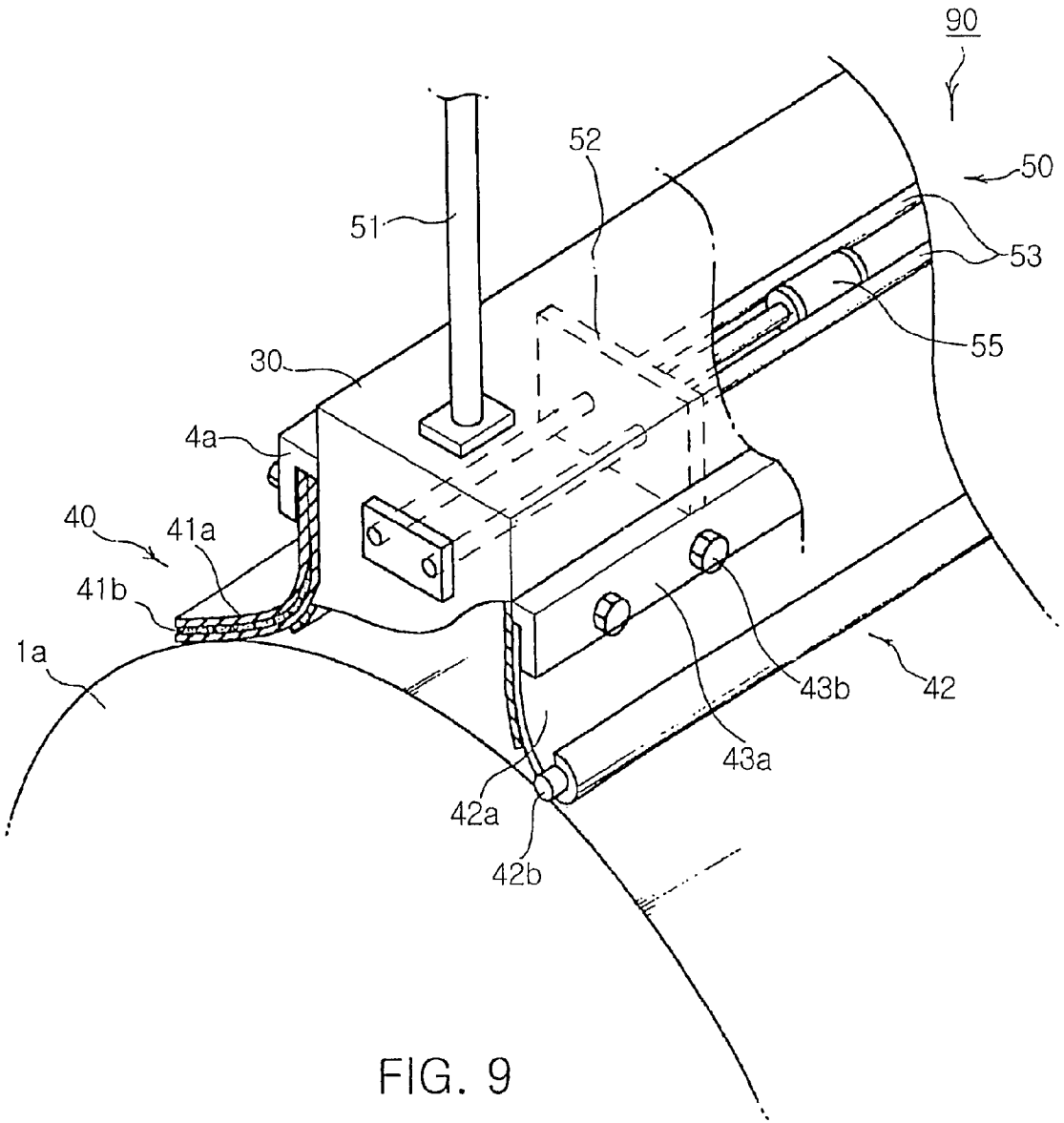
FIG. 9 is a perspective view of the apparatus for controlling gas layer thickness on the surface of a casting roll in a twin roll strip caster according to the invention.
Figure 10A:
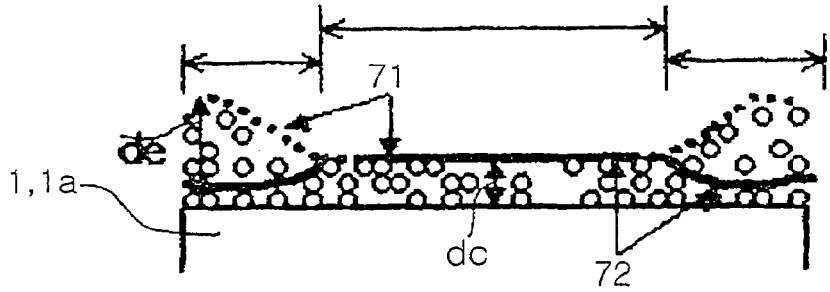
FIG. 10 schematically shows the apparatus for controlling gas layer thickness on the surface of a casting roll in a twin roll strip caster according to the invention along with a gas layer thickness profile.
Figure 10B:
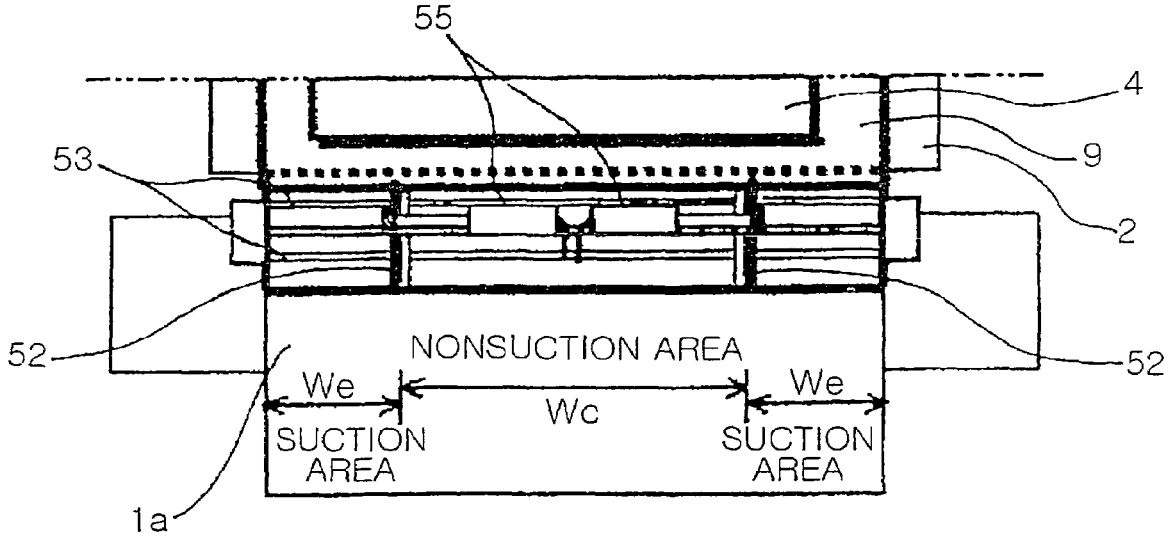

FIG. 7 is a sectional view of an apparatus for controlling gas layer thickness on the surface of a casting roll in a twin roll strip caster according to the invention, FIG. 8 is a plan view of the apparatus for controlling gas layer thickness on the surface of casting rolls in the twin roll strip caster according to the invention, FIG. 9 is a perspective view of the apparatus for controlling gas layer thickness on the surface of the casting roll in the twin roll strip caster according to the invention, and FIG. 10 schematically shows the apparatus for controlling gas layer thickness on the surface of a casting roll in a twin roll strip caster according to the invention along with a gas layer thickness profile.

Figure 3:
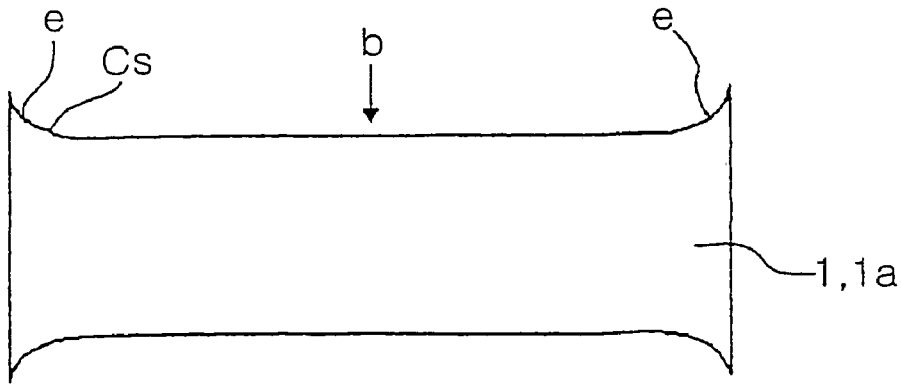
FIG. 3 schematically shows a configuration of a roll with crowns in a conventional twin roll strip caster.
Figure 2:
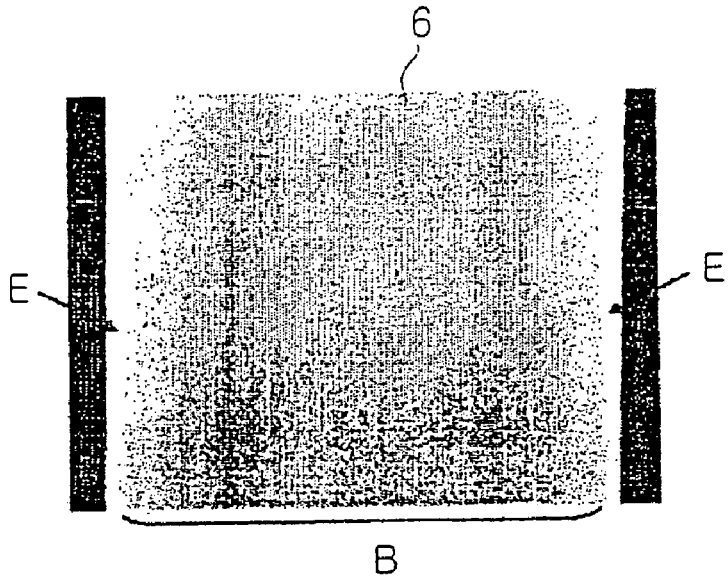
FIG. 2 shows a strip having hot bands at its edges owing to insufficient solidification.

As shown in FIGS. 7 to 10, a gas layer thickness control apparatus 90 of the invention is arranged in parallel with casting rolls 1 and 1*a*, extending from the front end to the rear end of a meniscus shield 9 covering over a molten metal pool 5 formed between the casting rolls 1 and 1*a* and edge dams 2. The control apparatus 90 serves to block introduction of heat transfer resistant particles, that is, foreign materials produced during casting as well as to adjust the thickness and width of gas layers at both ends e (FIG. 3) of the casting roll 1, 1*a* in order to prevent hot banding or bulging at the edges E of the strip 6 (FIG. 2). The control apparatus 90 includes chambers 30, blocking units 40, operating units 50 and a control unit 60. Although the control apparatus 90 is mounted in a symmetric configuration on both the casting rolls 1 and 1*a*, hereinafter description will be made about only a portion of the control apparatus 90 mounted on one of the casting rolls 1 and 1*a* by using similar reference numerals to designate similar components.

The chambers 30 are fixedly mounted on lateral portions of the meniscus shield 9 in a longitudinal direction of the rolls, i.e., a width direction of the strip 6. Each of the chambers 30 is a receiving member having a reverse U-shaped cross section with its opened lower end being opposed to the outer periphery of each of the casting rolls 1 and 1*a*. Preferably, the chamber 30 has a length equal to that of the casting roll 1, 1*a*.

The internal space of the chamber 30 is divided into suction edge portions where suction force is generated and a non-suction central portion where suction force is not generated, in which the operating unit 50 adjusts the width of the suction edge portions in respect to the non-suction central portion.

The blocking unit 40 shields the molten metal pool from foreign materials such as black layer powder, ceramic powder abraded from the edge dams 2, oxide scale powder dropped from the surface of the roll so that the foreign materials may not be mixed into the molten metal pool. The block unit 40 has a front barrier member 41 detachably assembled to a front portion of the chamber 30 and a rear barrier member 42 detachably assembled to a rear portion of the chamber 30, in which the front and rear barrier members 41 and 42 each have an underside which is arranged tight close with the outer periphery of the casting roll 1, 1*a*. A plurality of bolts 43*b* detachably assemble the front barrier member 41 to a reverse L-shaped holder 43*a* mounted on a front wall of the chamber 30 and the rear barrier member 42 to another reverse L-shaped holder 43*a* mounted on a rear wall of the chamber 30.

The front barrier member 41 includes a thin iron plate 41*a* in direct face-contact with the outer periphery of the casting roll 1, 1*a* and a permanent magnet 41*b* overlying the iron plate 41*a* for closely contacting the iron plate 41*a* with the casting roll 1, 1*a* under magnetic force. The permanent magnet 41*b*, in the form of a unitary piece or a number of mosaicked plates, is wrapped in a wrapper made of heat resistant cloth sized equal to the iron plate 41*a*. A heat resistant cover 41*c* is arranged on the permanent magnet 41*b* to protect the wrapper of the permanent magnet 41*b* from damage under hot temperature and thus to prevent demagnetization of the permanent magnet owing to hot molten metal.

Figure 1:
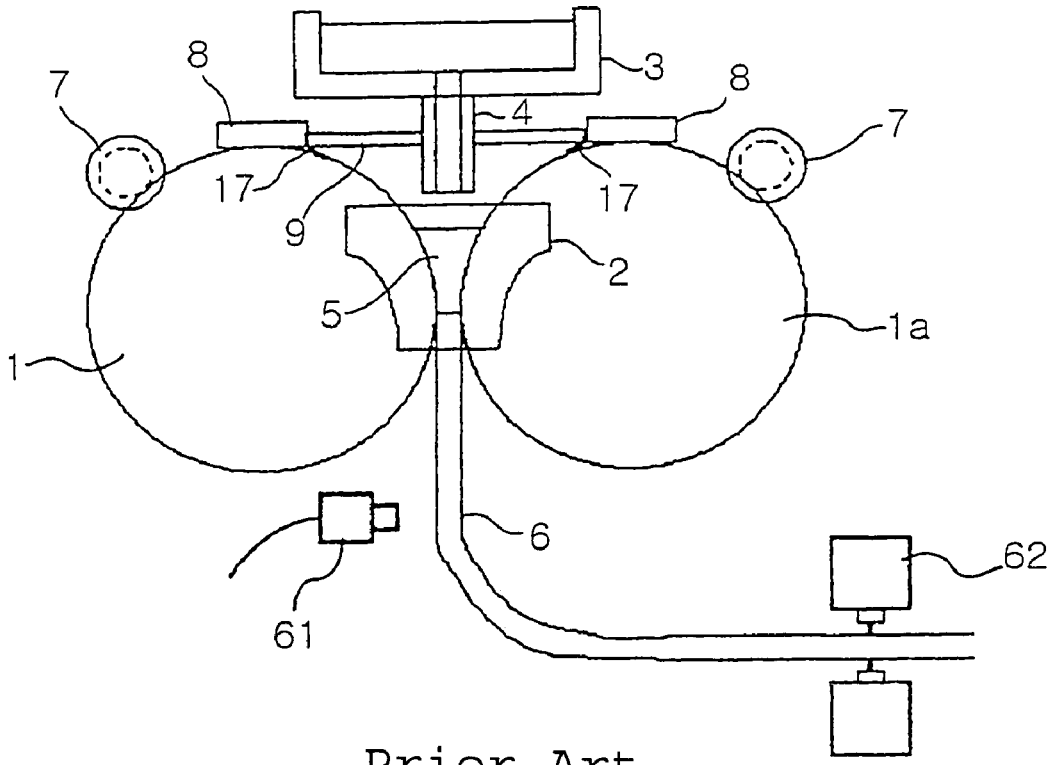
Prior Art FIG. 1
FIG. 1 schematically shows a conventional twin roll strip caster.

The rear barrier member 42 includes a thin iron plate 42*a* and a support 42*b* wrapped in a folded lower end of the iron plate 42*a*. The underside of the iron plate 42*a* is in direct facial-contact with the outer periphery of the casting roll 1, 1*a* between a brush roll 7 (FIG. 1) and the rear wall of the chamber 30, and the lower end of the iron plate 42*a* is folded to impart elastic force to the iron plate 42*a* so that the iron plate 42*a* tightly contacts with the outer periphery of the casting roll 1, 1*a*. The support 42*b* is vertically movable at both ends.

In order the tightly contact the iron plate 42*a* with the outer periphery of the casting roll 1, 1*a*, another permanent magnet having a predetermined strength level may be provided to the top of the rear barrier member 42. Elastic bodies (not shown) such as a spring may be installed at the both ends of the support 42*b* to elastically support the both ends of the support 42*b* downward. Such a configuration serves to block the open air from flowing into the molten metal pool 5 between the casting rolls 1, 1*a*.

The thin iron plates 41*a* and 42*a* of the front and rear barrier members 41 and 42 in contact with the casting rolls 1, 1*a* are preferably made of a material, which is same as that of steel to be cast and easily attracted by a magnet.

Because the iron plate 41*a* is a magnetic substance, even though debris are abraded from the iron plate 41*a* in friction with the roll surface owing to inadequate conditions including iron plate thickness, magnetic field strength and suction force of vacuum, the debris are captured by the permanent magnet 41*b* without being introduced into molten metal.

Preferably, the iron plates 41*a* and 42*a* are made of a material equal with that of molten metal in the casting process. Then, even if some of the debris produced from abrasion with the casting roll 1, 1*a* are introduced into molten metal, the influence of pollution can be relatively reduced.

Where the material for molten metal is a non-magnetic substance or a base metal having poor corrosion resistance, or is not easily manufactured or purchased, an iron plate of pure iron (100% purity) having clean surfaces is preferably selected for the iron plates 41*a* and 42*a*.

The thickness of the thin plates 41*a* and 42*a* is a very important factor regarding the endurance of the iron plates, roll surface damages and sealing. If the iron plates 41*a* and 42*a* are too thin, the iron plates. 41*a* may be readily torn by protrusions, if any, on the surface of the casting roll 1, 1*a* and thus may not control the gas layer thickness. On the contrary, if the iron plates 41*a* and 42*a* are too thick, the iron plates 41*a* and 42*a* may be waved from heat of high temperature. Then, a sharp edge of a waved region may create roll damages such as cracks when the iron plates 41*a* and 42*a* contact with the roll surface. Therefore, the thin iron plates 41*a* and 42*a* preferably have a thickness of about 30 to 60 μm if they are made of any of pure iron, steel and stainless steel.

Further, the permanent magnet 41*b* disposed on the iron plate 41*a* has magnet members with a predetermined magnitude of magnetic field strength, which are linearly disposed side by side across the permanent magnet 41*b*.

Since the surface of the casting roll 1, 1*a* is plated with Ni, that is, a ferromagnetic substance, the magnetic force of the permanent magnet 41*b* induces a magnetic force toward the roll surface causing the magnet 41*b* to strongly attract the casting roll 1, 1*a*. The magnetic force of the permanent magnet 41*b* has great effects on the contact state between the thin iron plate 41*a* and the casting roll 1, 1*a* and their gas sealing force based upon contact load.

The permanent magnet 41*b* preferably has a suitable value of magnetic field strength in respect to the material and the thickness of the iron plate 41*a*. If the magnetic field strength of the permanent magnet 41*b* is too small, the contact force between the iron plate 41*a* and the roll 1, 1*a* is weak thereby reducing sealing ability for blocking the open air. On the contrary, if the magnetic field strength is too large, the thin iron plate 41*a* may damage the surface of the roll 1, 1*a* forming for example scratches, which may cause severe defects on the strip surface such as cracks formed in a longitudinal direction of the strip.

Although the magnetic field strength of the permanent magnet 41*b* may be varied according to the material and the thickness of the iron plate 41*a*, surface conditions of the casting roll 1, 1*a* and the area ratio of the mosaicked permanent magnet 41*b* or the thickness of the magnet, the magnetic field strength of the permanent magnet 41*b* is most preferably in a range of about 500 to 1500 Oe based upon ferritic magnet members having a thickness of about 2 to 6 mm.

The wrapper enclosing the permanent magnet 41*b* on the iron plate 41*a* is made of a heat resistant ceramic cloth capable of sufficiently enduring in a temperature range of about 200 to 500° C. The heat resistant cover 41*c* is disposed on the wrapper to prevent the wrapper from being directly exposed to hot molten metal and atmospheric gas or subsequently burnt. The heat resistant cover 41*c* also prevents demagnetization of the permanent magnet 41*b*.

The protective heat resistant cover 41*c* is preferably made of a thin iron plate or a ceramic cloth which can sufficiently endure in a high temperature atmosphere.

A blower 45 is arranged between the rear barrier member 42 and the brush roll 7, which blows inert gas toward the outer periphery of the casting roll 1, 1*a* along the entire length thereof in order to shield the chamber from the open air and large particles of heat transfer resistant substance such as black layer powder abraded from the roll surface, abraded edge dam powder and fine oxide scale. The blower 45 is arranged in parallel with the roll along the entire length of the roll, and has a nozzle 46 with an opened slit 46*a* in its underside and a gas feed line 47 for feeding inert gas.

It is preferred that the slit 46*a* of the nozzle 46 has a width of about 50 to 300 μm while nitrogen gas is fed at a pressure of 4 to 10 bar through the gas feed line 47 and injected from the leading end of the slit 46*a* at an injection rate of 30 to 150 m/sec. If nitrogen gas collides into the surface of the casting roll 1, 1*a* at a low rate of about 30 m/sec or less, pollutants such as the heat transfer resistant substance are not readily removed. On the contrary, an excessive quantity of gas may be consumed to raise the injection rate of gas even though a higher injection rate of nitrogen gas is more advantageous. As a result, it is most preferable to inject nitrogen gas under the above condition.

The operating unit 50 functioning to adjust the thickness and the width of the gas layer at the both ends of the casting roll 1, 1*a* includes a pair of suction lines 51 which communicate by their lower ends with both side portions in the top of the chamber 30 to apply suction force to suction areas in both side portions of the chamber 30 so that suction force can be applied to the both ends e of the casting roll 1, 1*a*. Each of the suction lines 51 communicates with a suction pump (not shown), and has an control valve 51*a* which is opened/closed by a single action controller 65.

Further, the chamber 30 has movable plates 52 installed in its inner space, which are laterally slided in the both side portions of the chamber 30 to adjust the width of the suction areas. The movable plates 52 are assembled, respectively, with a pair of operating members 55 which are arranged in non-suction areas and exert driving force to laterally reciprocate the movable plates 52.

The chamber 30 is divided into three parts in respect to the entire length W of the casting roll 1, 1*a*, which include the two suction areas We formed in the both side portions of the chamber 30 and the non-suction area Wc (=W−2We) formed in the central area of the chamber 30.

The movable plates 52 are slidably assembled respectively to a pair of guide bars 53 which are installed within the each chamber 30 so that the movable plates 52 can perform efficient reciprocating motion. From the both ends of the chamber 30, the movable plates 52 are moved inward up to critical positions which are distanced to 10 through 15 mm from the both ends. The bottom of the each suction line 51 communicates with the chamber 30 between one end and each critical position.

Each of the operating members 55 maybe formed of a cylinder member, which is arranged in the inner space of the chamber 30 corresponding to the non-suction area and connected by the leading end of its rod to each of the movable plates 52 to horizontally move the each movable plate 52. Alternatively, the each operating member 55 may be formed of a motor member for rotating a screw shaft meshed with a bolt hole.

The control unit 60 functioning to control the operation of the operating members 55 and the control valves 51*a* in the suction lines 51 is installed between an entry pinch roll and a coiler for winding the strip to detect the width and quantity of hot banding or bulging at the both lateral edges of the strip 6. The control unit 60 includes a camera 61 installed in a loop pit right below a roll nip between the casting rolls 1, 1*a*. The camera 61 detects existence of hot banding or bulging and its degree, if any, based upon contrast difference according to temperature variation in a width direction of the strip. The control unit 60 also includes a thickness meter 62 installed between the entry pinch roll and the coiler for winding the strip to measure the thickness profile of the strip 6 in a width direction thereof.

The control unit 60 further includes a controller 63 which is connected with both the camera 61 and the thickness meter 62 to generate a suction force control signal $e_p$ and a width control signal $e_w$ based upon measured values. The controller 63 adjusts the opening ratio of the control valves 51*a* in the suction lines 51, and is connected with the single action controllers 65 which are electrically connected with the operating members 55 to operate the same. Each of the single action controllers 65 is connected with each of the operating members 55 to independently control the suction force via the suction line 51 and the width adjustment via the operating member 55.

Such a feedback system is adapted to continuously operate on-line during the casting process until hot banding or bulging is completely eliminated from the both edges of the strip.

Hereinafter description will disclose the operation of the invention having the above construction.

Figure 6:
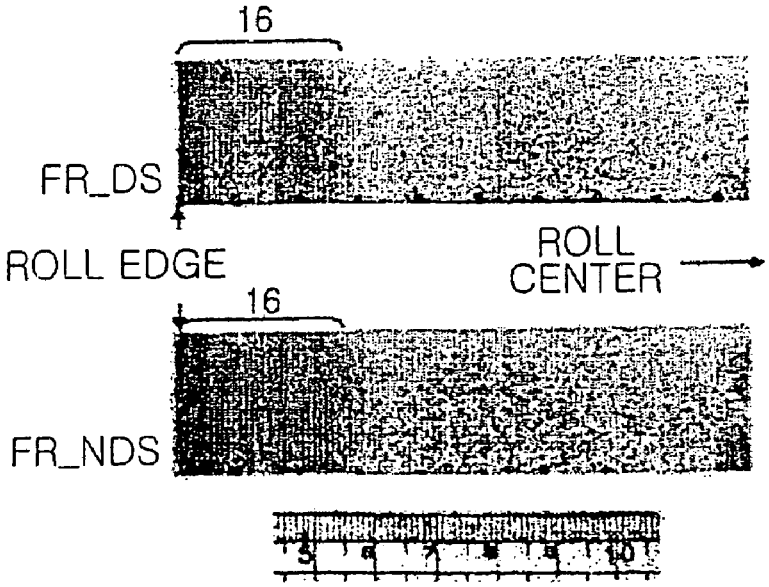
FIG. 6 shows variation in concentration of pollutants deposited on both lateral ends and a central face of a roll at completion of strip casting.
Figure 4:
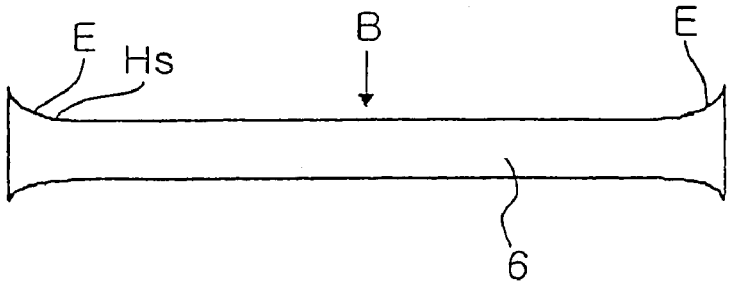
FIG. 4 schematically shows a configuration of a strip having hot bands at its both ends in a conventional twin roll strip caster.
Figure 5:
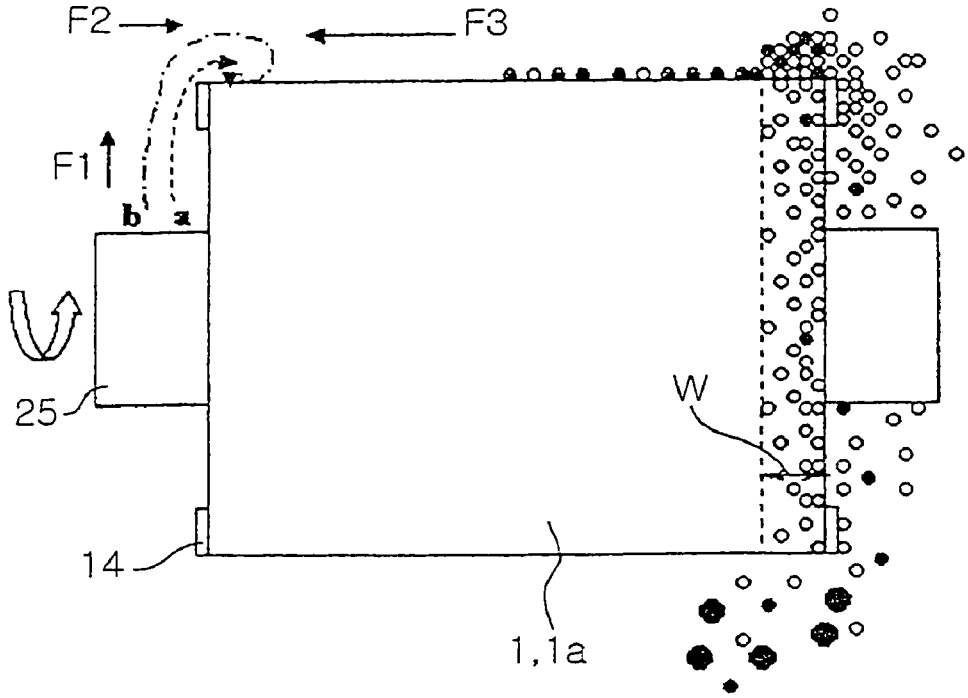
Prior Art FIG. 5
FIG. 5 schematically shows fluid behavior around a surface and sides of a roll in a conventional twin roll strip caster.

First, as shown in FIGS. 5 and 6, it has been observed that in general hot banding or bulging at the both edge E of the strip 6 is closely related to fluid on the surface of the casting roll 1, 1*a*.

Also, as shown in FIG. 10, fluid is more collectively accumulated in the suction areas We or on the both ends of the casting roll 1, 1*a* compared with the non-suction area Wc in the central portion of roll barrel, and atmospheric gas such as nitrogen or oxygen has a large value of layer thickness in the suction areas We as indicated with a gas profile P in FIG. 10. Because the external pollutants such as powder abraded from the edge dams 2 and oxide scale powder are heavily accumulated on the ends e of the casting roll according to characteristics of the twin roll strip caster 100, solidification is delayed at the roll ends e owing to degradation in the cooling ability of the roll compared with at the roll barrel central portion b.

Such a phenomenon may occur as casting time elapses even though this phenomenon was not observed in an early stage of casting. Time-elapsing is closely related to the above-described fluid accumulation. As a result, where hot banding or bulging takes place at the both edges E, bulging cannot be avoided without enhancing the cooling ability of the suction areas We at the both ends e of the casting roll 1, 1*a* in comparison with that of the non-suction area Wc in the roll barrel central portion b.

That is, when the strip 6 is transported through the roll nip between the casting rolls 1 and 1*a* at the beginning of the casting process, the control apparatus 10 of the invention photographs the strip 6 with the hot strip monitoring camera 61 within the loop pit right below the roll nip to observe an image of the strip 6. Where the strip 6 is normally cast without hot banding or bulging owing to insufficiently solidified metal at the strip edges, brightness difference is not observed in a width direction of the strip 6 and thus it is understood that the strip 6 is being cast at a uniform temperature (brightness) across its entire width. Then, a suction force control signal $e_p$ or a width control signal $e_w$ is not sent to the suction lines 51 and the operating members 55 via the controller 63 and the single action controller 65.

Instead, nitrogen gas of high pressure is fed toward the outer periphery of the casting rolls 1 and 1*a* by the blower 45 installed between the chamber 30 and the brush roll 7 in order to block introduction of external oxygen or the pollutants including abraded black layer powder, ceramic powder such as abraded edge dam powder and oxide scale powder which may act as heat transfer resistant particles.

In the meantime, if the both edges E of the strip 6 are bulged as shown in FIG. 2 in the casting process under the above-described casting conditions, the image photographed by the camera 61 shows brightness difference at the both edges of the strip 6 (in which the edges E of the strip are locally brighter than the central portion B of the strip) thereby to notify hot banding or bulging.

In this case, the width or quantity of hot banding or bulging is measured at the edges E of the strip 6 with the thickness meter arranged at an output side in respect to a casting direction of the strip 6. A measured value of width or quantity is transmitted to the controller 63, which in response to the value controls the cooling ability at the ends of the casting rolls 1 and 1*a* so that the thickness de/dc of the gas layer on the roll surface can be adjusted to form the gas layer profile as designated with the reference number 72 in FIG. 10.

That is, control is performed according to conditions suitable to the degree of hot banding or bulging at the edges of the strip 6, in which a suction force control signal $e_p$ and a width control signal $e_w$ calculated by the controller 63 are transmitted to the operating members 55 and the control valves 51*a* in the suction lines via the single action controller 63, which is in electrical connection with the controller 63 for individually receiving operation signals therefrom, to adequately control the internal pressure P and the variation of the movable plates in the both lateral spaces of the chamber, thereby adjusting both the thickness de and the width We of the gas layer at the ends of the casting rolls 1 and 1*a*.

The suction force transmitted to the chamber and its both lateral internal spaces when the opening ratio of suction valves in the suction lines is increased or decreased. So, the contacting force can be adjusted by increasing and/or decreasing the intervals between the outer peripheries of the casting rolls and the thin iron plates 41*a* and 42*a* of the front and rear barrier members 41 and 42, which are mounted on the front and rear portions of the chamber 30. Further, when the operating members 55 are actuated to move the movable plates 52 toward the edges along the guide bars 53, the suction areas in both ends of the chamber 30 are contracted to enlarge the suction force while the edge width is reduced. On the contrary, when the movable plates 52 are moved inward, the suction areas are expanded to reduce the suction force while the edge width is increased.

The feedback system is adapted to continuously operate on-line until hot banding or bulging owing to insufficiently solidified metal at the both edges of the strip is completely removed.

According to the invention as set forth above, the pollutants such as black layer powder abraded from the rolls, abraded edge dam powder and oxide scale powder functioning as heat transfer resistant particles as well as creating cracks on the casting rolls are removed through suction in the suction areas We on the ends of the casting rolls corresponding to the fluid-accumulating portions where the strip edges tend to be insufficiently solidified. Also, the thickness of atmospheric gas between the roll and the solidification shell functioning to determine the cooling ability of the casting rolls is adjusted in cooperation with hot banding or bulging on-line during casting so that the gas layer thickness $d_e$ on the roll ends and the gas layer thickness $d_c$ on the roll barrel central portions are adjusted different from each other through adjustment of the suction force of gas from hermetic spaces at both ends of the rolls and the width of the hermetic spaces. In this manner, the invention can actively and rapidly cope with insufficient solidification as well as improve the quality and yield of the strip and the stability of the operation.

Although the preferred embodiments of the present invention have been disclosed for illustrative purposes, those skilled in the art will appreciate that various modifications, additions and substitutions can be made without departing from the scope and spirit of the invention as disclosed in the accompanying claims.

The invention claimed is:

1. In a twin roll strip caster which includes a pair of casting rolls equipped with edge dams for forming a molten metal pool, a meniscus shield covering the molten metal pool for blocking contact between the open air and molten metal and brush rolls for brushing the surface of each of the casting rolls, an apparatus for controlling gas layer thickness on the surface of each casting roll comprising:

a pair of chambers fixedly mounted on both lateral portions of the meniscus shield in a width direction of a strip;

blocking units for blocking introduction of pollutants into the molten metal pool, wherein each of the blocking units includes front and rear barrier members, which are mounted on each of the chambers and in close contact with an outer periphery of each casting roll, and a blower for injecting inert gas toward the outer periphery of each casting roll;

operating units for adjusting the thickness and the width of gas layers at both ends of the casting rolls, wherein each of the operating units includes suction lines connected with each chamber to transmit a suction force to ends of each casting roll and a pair of movable plates slidably assembled to both side portions within each chamber for reciprocation by a pair of operating members; and a control unit for controlling the suction force of the suction lines and the movable members by using means for measuring surface conditions and the thickness of the strip.

2. An apparatus for controlling gas layer thickness as set forth in claim 1, wherein each chamber is shaped as a box having an opening in a lower portion, the opening being opposed to the outer periphery of each casting roll.

3. An apparatus for controlling gas layer thickness as set forth in claim 1, wherein the front barrier member includes:

a first thin iron plate in direct face-contact with the outer periphery of each casting roll;

a permanent magnet overlying the first iron plate, wrapped in a wrapper made of heat resistant cloth having a size equal to the first iron plate, and in the form of a unitary piece or a number of mosaicked plates, for closely contacting the first iron plate with each casting roll under a magnetic force; and a heat resistant cover arranged on the permanent magnet for protecting the wrapper from damage under hot temperature and preventing demagnetization of the permanent magnet owing to hot molten metal.

4. An apparatus for controlling gas layer thickness as set forth in claim 1, wherein the rear barrier member includes:

a second thin iron plate disposed between each of the brush rolls and a rear wall of each chamber, and having an underside in direct face-contact with the outer periphery of each casting roll; and a support wrapped in a folded lower end of the second iron plate and vertically movable at both ends, the lower end of the second iron plate being folded to impart elastic force to the second iron plate so that the second iron plate is in tight contact with the outer periphery of each casting roll.

5. An apparatus for controlling gas layer thickness as set forth in claim 3, wherein the first thin iron plate is made of a material which is the same as that of a steel to be cast and easily attracted by a magnet, and has a thickness of about 30 to 60 μm.

6. An apparatus for controlling gas layer thickness as set forth in claim 3, wherein the permanent magnet has a magnetic field strength in a range of about 500 to 1500 Oe based upon a ferritic magnet member having a thickness of about 2 to 6 mm.

7. An apparatus for controlling gas layer thickness as set forth in claim 1, wherein the blower is arranged in parallel with the roll along the entire length thereof, and has a nozzle with an opened slit in its underside and a gas feed line for feeding inert gas.

8. An apparatus for controlling gas layer thickness as set forth in claim 7, wherein the slit of the nozzle has a width of about 50 to 300 μm, whereby nitrogen gas is fed at a pressure of 4 to 10 bar through the gas feed line and injected from a leading end of the slit at an injection rate of 30 to 150 m/sec.

9. An apparatus for controlling gas layer thickness as set forth in claim 1, wherein the movable plates are slidably assembled respectively to a pair of guide bars which are installed within each chamber so that the movable plates can perform efficient reciprocating motion.

10. An apparatus for controlling gas layer thickness as set forth in claim 1, wherein each of the operating members is a cylinder member connected by a leading end with each of the movable plates.

11. An apparatus for controlling gas layer thickness as set forth in claim 1, wherein the measuring means include a camera for measuring surface conditions of the strip, a thickness meter, and wherein the control unit includes:

a controller for generating a suction force control signal $e_p$ and a width control signal $e_w$ based upon measured values from the camera and the thickness meter; and a signal action controller for operating the suction lines and the operating members in response to the control signals from the controller.

12. In a twin roll strip caster for casting a strip which includes a pair of counter-rotating casting rolls, edge dams disposed at both ends of the casting rolls for forming a molten metal pool, a meniscus shield covering over the molten metal pool for blocking contact between the open air and molten metal and brush rolls for brushing the surface of each of the casting rolls, an apparatus for controlling gas layer thickness on the surface of each casting roll comprising:

a pair of chambers fixedly mounted on both lateral portions of the meniscus shield in a width direction of the strip, and each having a U-shaped cross section with its opened lower end being opposed to an outer periphery of each casting roll;

blocking units for blocking introduction of pollutants into the molten metal pool, wherein each of the blocking units includes front and rear barrier members, which are detachably mounted on front and rear walls of each of the chambers and in close contact by their undersides with the outer periphery of each casting roll, and a blower for injecting inert gas toward the outer periphery of each casting roll;

operating units for adjusting the thickness and the width of gas layers at both ends of the casting rolls, wherein each of the operating units includes: a pair of suction lines communicating respectively with both side portions of each of the chambers to transmit suction force to ends of the each casting roll, a pair of movable plates slidably assembled to both end portions within each chamber, and a pair of operating members for reciprocating the movable plates; and a control unit including a controller for generating a suction force control signal $e_p$ and a width control signal $e_w$ based upon measured values from a camera for measuring surface conditions of the strip and a thickness meter for measuring the thickness of the strip, and a single action controller for receiving the control signals from the single action controller and electrically connected to the suction lines and the operating members.

13. An apparatus for controlling gas layer thickness as set forth in claim 12, wherein the front barrier member includes:

a first thin iron plate in direct face-contact with the outer periphery of each casting roll;

a permanent magnet overlying the first iron plate, wrapped in a wrapper made of heat resistant cloth having a size equal to the first iron plate, and in the form of a unitary piece or a number of mosaicked plates, for closely contacting the first iron plate with each casting roll under magnetic force; and a heat resistant cover arranged on the permanent magnet for protecting the wrapper from damage under hot temperature and preventing demagnetization of the permanent magnet owing to hot molten metal.

14. An apparatus for controlling gas layer thickness as set forth in claim 12, wherein the rear barrier member includes:

a second thin iron plate disposed between each of the brush rolls and a rear wall of each chamber, and having an underside in direct face-contact with the outer periphery of each casting roll; and a support wrapped in a folded lower end of the second iron plate and vertically movable at both ends, the lower end of the second iron plate being folded to impart elastic force to the second iron plate so that the second iron plate can be in tight contact with the outer periphery of each casting roll.

15. An apparatus for controlling gas layer thickness as set forth in claim 13, wherein the first thin iron plate is made of a same material as that of steel to be cast and easily attracted by a magnet, and has a thickness of about 30 to 60 μm.

16. An apparatus for controlling gas layer thickness as set forth in claim 13, wherein the permanent magnet has a magnetic field strength in a range of about 500 to 1500 Oe based upon a ferritic magnet member having a thickness of about 2 to 6 mm.

17. An apparatus for controlling gas layer thickness as set forth in claim 12, wherein the blower is arranged in parallel with the roll along the entire length thereof, and has a nozzle with an opened slit in its underside and a gas feed line for feeding inert gas.

18. An apparatus for controlling gas layer thickness as set forth in claim 17, wherein the slit of the nozzle has a width of about 50 to 300 μm, whereby nitrogen gas is fed at a pressure of 4 to 10 bar through the gas feed line and injected from a leading end of the slit at an injection rate of 30 to 150 m/sec.

19. An apparatus for controlling gas layer thickness as set forth in claim 12, wherein the movable plates are slidably assembled respectively to a pair of guide bars which are installed within each of the chambers so that the movable plates can perform efficient reciprocating motion.

20. An apparatus for controlling gas layer thickness as set forth in claim 12, wherein each of the operating members is a cylinder member connected by a leading end with each of the movable plates.

21. An apparatus for controlling gas layer thickness as set forth in claim 4, wherein the second thin iron plate is made of a material which is the same as that of a steel to be cast and easily attracted by a magnet, and has a thickness of about 30 to 60 μm.

* * * * *

UNITED STATES PATENT AND TRADEMARK OFFICE

CERTIFICATE OF CORRECTION

PATENT NO. : 7,323,135 B2
APPLICATION NO. : 10/499908
DATED : January 29, 2008
INVENTOR(S) : Ju-Tae Choi et al.

It is certified that error appears in the above-identified patent and that said Letters Patent is hereby corrected as shown below:

Column 14, Line 24 of Claim 12, "ends of the each" should read -- ends of each --

Signed and Sealed this

Twenty-second Day of July, 2008

JON W. DUDAS
*Director of the United States Patent and Trademark Office*